United States Patent [19]

Mougin

[11] 4,289,423

[45] Sep. 15, 1981

[54] PROTECTIVE SKIRT FOR AN ICEBERG

[75] Inventor: Georges L. Mougin, Paris, France

[73] Assignee: I.T.I. Limited, Paris, France

[21] Appl. No.: 96,037

[22] Filed: Nov. 20, 1979

[30] Foreign Application Priority Data

Nov. 22, 1978 [GB] United Kingdom ..... 45638/78

[51] Int. Cl.[3] ..... E02B 1/00

[52] U.S. Cl. ..... 405/61; 405/66; 405/211

[58] Field of Search ..... 405/52, 61, 63, 66, 405/72, 211

[56] References Cited

U.S. PATENT DOCUMENTS

| | | | |
|---|---|---|---|
| 3,289,415 | 12/1966 | Merrill | 405/76 |
| 3,921,407 | 11/1975 | Neal | 405/63 |
| 4,089,178 | 5/1978 | Kinase et al. | 405/66 |
| 4,172,751 | 10/1979 | Mougin | 405/61 X |

OTHER PUBLICATIONS

Ocean Industry, Mar. 1973, pp. 28–29.
Match, Oct. 30, 1976.

*Primary Examiner*—David H. Corbin
*Attorney, Agent, or Firm*—George E. Kersey

[57] ABSTRACT

A protective skirt for a tabular iceberg (10) comprises a string of floating posts which support an upper protective portion near the water line. This portion is constituted by flexible panels (12) which provide both thermal protection and mechanical protection against wave action. Certain posts (e.g. A, B and F) include vertically arranged furling drums for winding-in the panels (12) attached thereto in order to fit the length of the skirt around the perimeter of iceberg.

The skirt also includes a lower protective portion (e.g. spans 50, 52, 54) which is suspended from below the floating posts. This portion need only provide thermal protection since it is suspended below the deepest expected wave troughs. It is too large (e.g. 200 m) in the vertical direction for it to be conveniently wound-in on furling drums like the upper protective portion. In order to accommodate changes in the perimeter of the upper portion it is therefore split vertically and adjacent spans allowed to overlap by a variable amount using an auxiliary float moored some way along the upper portion.

4 Claims, 5 Drawing Figures

PROTECTIVE SKIRT FOR AN ICEBERG

The present invention relates to a protective skirt for a tabular iceberg and to ensuring that the skirt fits around the iceberg both when initially deployed and during transport of the iceberg from Antarctic waters to a point of use.

There have been several proposals for towing tabular icebergs, such as are calved from Antarctic ice shelves, to coastal regions that require fresh water. Recent proposals have mostly envisaged regions such as the Arabian peninsular, Australia and California. Because of their regular shape, tabular icebergs from the Antarctic are essential for this purpose (even for Northern Hemisphere destinations). Other icebergs, and especially Arctic icebergs, are irregular and are therefore prone to capsizing as their flanks are eaten away by melting and the mechanical action of the waves. Nonetheless, to avoid excessive loss, even from a tabular iceberg, it is necessary to provide some form of thermal and mechanical protection around the iceberg during towing. Such protection is provided by a barrier referred to herein as a "skirt". In outline, such a skirt comprises three main components: floats; an upper protective portion which is supported by the floats and which provides mechanical protection against waves and swell in addition to the thermal protection it provides by trapping a zone of cold water around the iceberg; and a lower protective portion which provides a thermal protection around that part of the iceberg which remains submerged even in the heaviest seas expected.

These components are described in greater detail elsewhere, and for an understanding of the present invention it is sufficient to understand that our preferred floats are generally stable vertically in spite of waves e.g. by virtue of their principal buoyancy chamber being located deep below the surface of the sea and their portion which projects above the surface being of relatively small cross section. This portion which projects above the surface may be in the form of a pole or a hollow tower according to the design used and the term "post" is used herein as being generic of such portions regardless of their relative outside dimensions. The preferred upper protective portion of the skirt comprises at least one layer of matted nylon braid slung in vertical panels between the posts of two adjacent floats, while the preferred lower protective portion comprises panels of plastics material which, when in position, are suspended from cables joining the lowest points of adjacent floating posts. The lower protective portion is released for deployment in the manner of a Venetian blind only after the remainder of the skirt has been installed around an iceberg.

A typical tabular iceberg is 200 m to 250 m thick and its width must be sufficient to keep it from capsizing, even after suffering some loss from melting and wave attack—say 400 m to 500 m. Its length may be of the order of 1 km to 2 km or even more. This results in a total perimeter in the order of a few km. Since the exact perimeter of the iceberg for which the skirt is intended will not be known at the time a protective skirt is being manufactured, and since the iceberg will shrink during towing through warm waters, it is important that the protective skirt can be adjusted in perimeter during use, both during initial deployment and "fitting" around the iceberg, and subsequently as much as turns out to be necessary due to shrinkage.

Our co-pending application of the same date (our ref. ASM 1024) describes a protective skirt comprising a string of floating posts interconnected by an upper protective portion constituted by panels of flexible sheet material. The panels are suspended in a vertical plane between each pair of adjacent posts. Spaced out generally evenly along the string of floating posts there are "winch" posts which include furling drums for winching in the panel or panels suspended between the "winch" posts and their neighbouring posts. Clearly with such an arrangement there is little difficulty in fitting the upper protective portion of the skirt around an iceberg, once the skirt has been deployed in approximately the desired position. The fully extended skirt is chosen to be too long for the required perimeter and then it is shortened as necessary by winching-in appropriate lengths of panel on the furling drums of the winch posts.

A problem arises, however, with the lower protective portion of the protective skirt. As mentioned above, the total thickness of iceberg to be protected is about 200 to 250 m, while the height of the floating posts and the flexible panels suspended in between them is about one fifth of this thickness, say 40 to 50 m. The lower protective portion of the skirt is deployed by unfolding like a Venetian blind downwards from below the floating posts. It thus extends too far vertically for it to be possible to wind it in about vertically disposed drums. The problem is one of enabling the lower protective portion to accomodate shortening of the upper protective portion.

The present invention solves this problem by providing a protective skirt for a tabular iceberg, the skirt comprising:

a string of floating posts;

an upper protective portion in the form of panels suspended in a vertical plane between adjacent pairs of the floating posts;

a lower protective portions suspended below the floating posts; and at least one auxiliary float;

at least one of the floating posts including panel-manipulating means for drawing in at least one of the panels suspended therefrom, whereby the length of the string of floating posts may be shortened by shortening the length of at least one of the spans between floating posts;

the lower protective portion being attached to the floating posts in such a way that it is supported by the floating posts for each span of the string of floating posts that is not capable of being shortened by panel-manipulating means;

the lower protective portion including a vertically extending division associated with each floating post that includes panel-manipulating means, with one edge of the division being supported by one of the floating posts and the other edge of the division being supported by a corresponding auxiliary float, the length of the or each span of the lower protective portion having one end supported by the auxiliary float being such that the edges of the division overlap and the degree of overlap is adjustable by moving the position of the auxiliary float relative to the string of floating posts in order to accomodate shortenings of the length of the string of floats.

In a preferred embodiment the lower protective portion includes two vertically extending divisions associated with each floating post that includes panel-manipulating means, thereby defining an auxiliary span of the lower protective portion, one end of the auxiliary span being suspended from a floating post, with the remainder of the lower protective portion overlapping it at the post, and the other end of the auxiliary span being supported by the auxiliary post.

Generally each floating post that includes panel-manipulating means should include means for shortening two panels of the upper protective portion (one on either side of the post), in which case the lower protective portion is not supported by such a post at all, but passes beneath it without being fastened thereto.

The auxiliary float overlaps the string of posts to ensure a continuous, or at least a nearly continuous, protection of the lower part of the iceberg. It is important to avoid its damaging the part of the skirt which it overlaps. One way of doing this is to provide the auxiliary float with a fin to be acted upon by the water flowing past a tabular iceberg which is protected by the skirt and which is under way towards a destination. The float will also need to be moored to at least one of the floating posts of the string of posts. Appropriate placing of the mooring point(s) on the auxiliary float and an appropriate angle for the fin will ensure that there is a dynamic tendency for the auxiliary post to move away from the iceberg which tendency is counteracted by the mooring.

An embodiment of a protective skirt in accordance with the invention is described by way of example with reference to the accompanying drawings in which.

Figure 5:
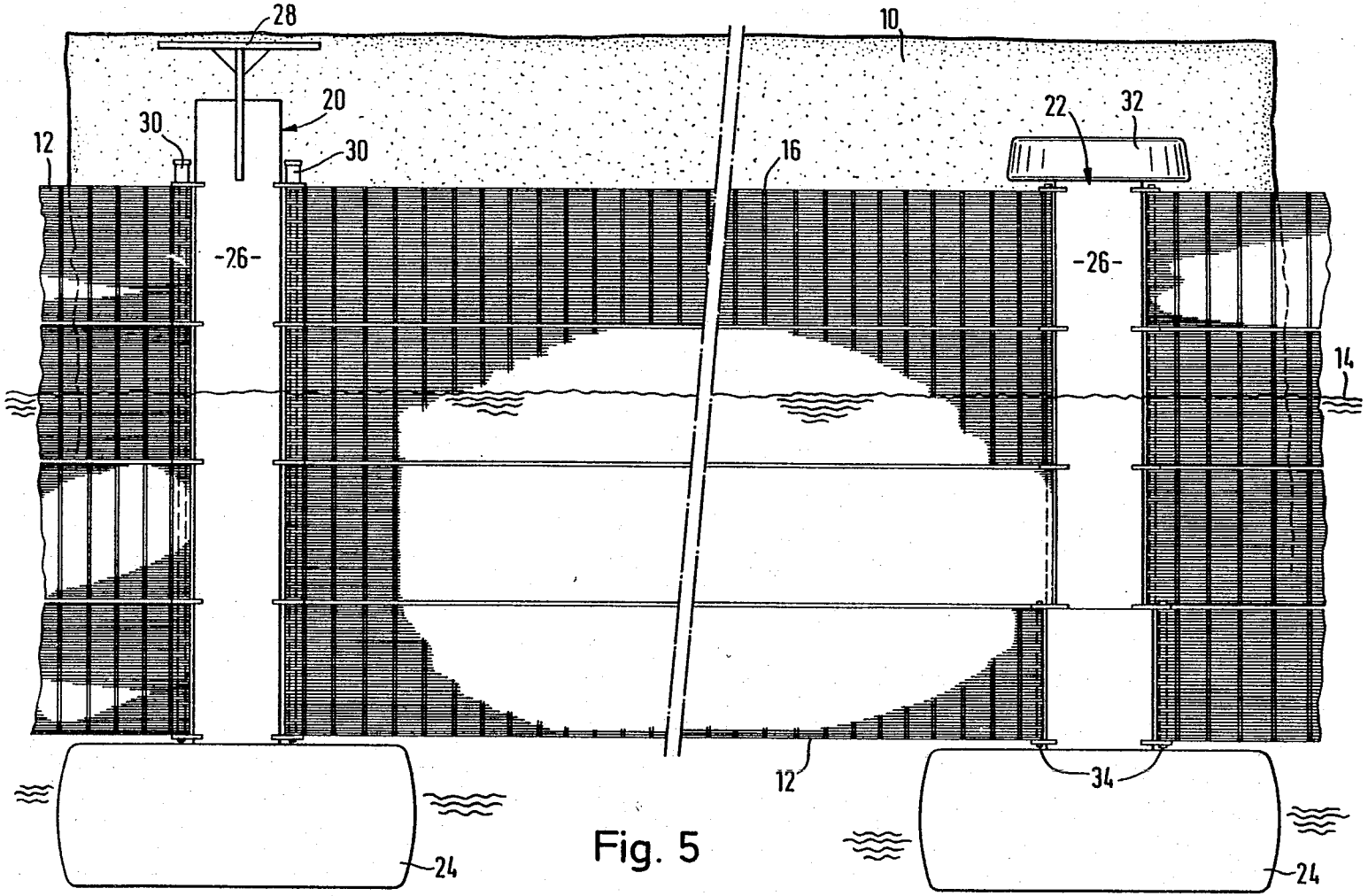
FIG. 5 is a side view on a larger scale than FIG. 4 of a region indicated by an outline V in FIG. 1.

The nature of the upper portion of the protective skirt is best seen in FIG. 5 which shows the upper portion in its operative position. The top of a tabular iceberg (10) can be seen projecting above panels (12) of the protective skirt. The panels (12) are slung in a vertical plane parallel to the flank of the iceberg (10) between adjacent pairs of floating posts e.g. a winch post (20) and an intermediate post (22). The surface of the sea is indicated at (14), and since about $\frac{7}{8}$ths of an iceberg is below the surface it will be appreciated that the bottom of the iceberg (10) is well below the bottom edge of the drawing.

Both of the floating posts (20) and (22) comprise a deeply submerged buoyancy chamber (24) in the form of a large diameter horizontal disc or wheel supporting an upwardly extending pole (26) of much smaller diameter. The floating posts are ballasted so that they remain upright and their vertical displacement in a swell is considerbly less than that of the surrounding water surface. The winch post (20) is distinguished from an intermediate floating post (22) by including a helicopter deck (28) and two vertically extending furling drums (30) for winching in (furling) the panels of skirt to which the winch post (20) is attached. The furling drums (30) are hydraulically driven by a diesel-powered hydraulic system, not shown. The intermediate floating post (22) is terminated by a cap (32) and is connected to the panels (12) by pins (34) which are not equipped to be rotated.

The panels of the protective skirt are constituted by a large number of horizontal tapes of nylon braid which are placed substantially edge to edge with each other. At intervals these tapes are fastened to vertical tapes (16) (e.g. by stitching) to provide a partially permeable trellis-like or hurdle-like matted barrier to the sea. The panels (12) are reinforced longitudinally on either side thereof by horizontal straps (18).

Figure 1:
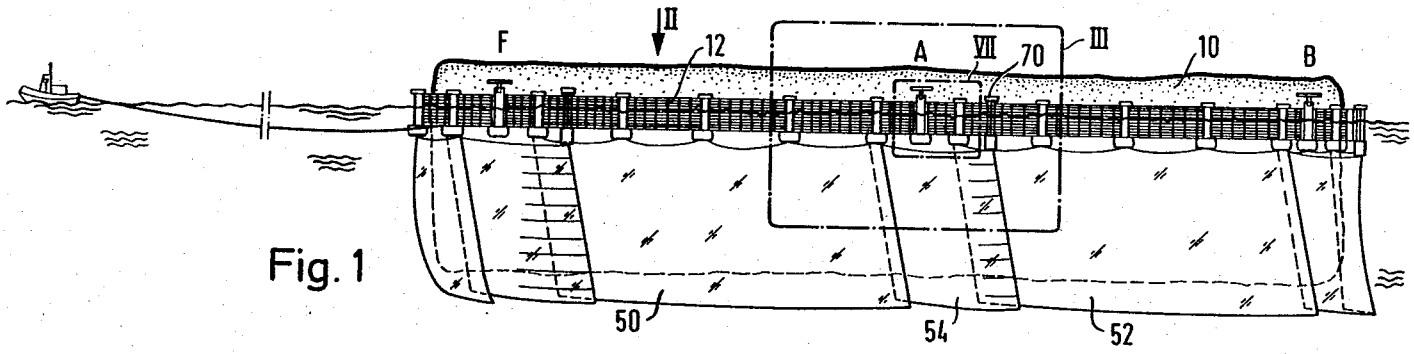
FIG. 1 is a side view of a tabular iceberg protected by a skirt.
Figure 2:
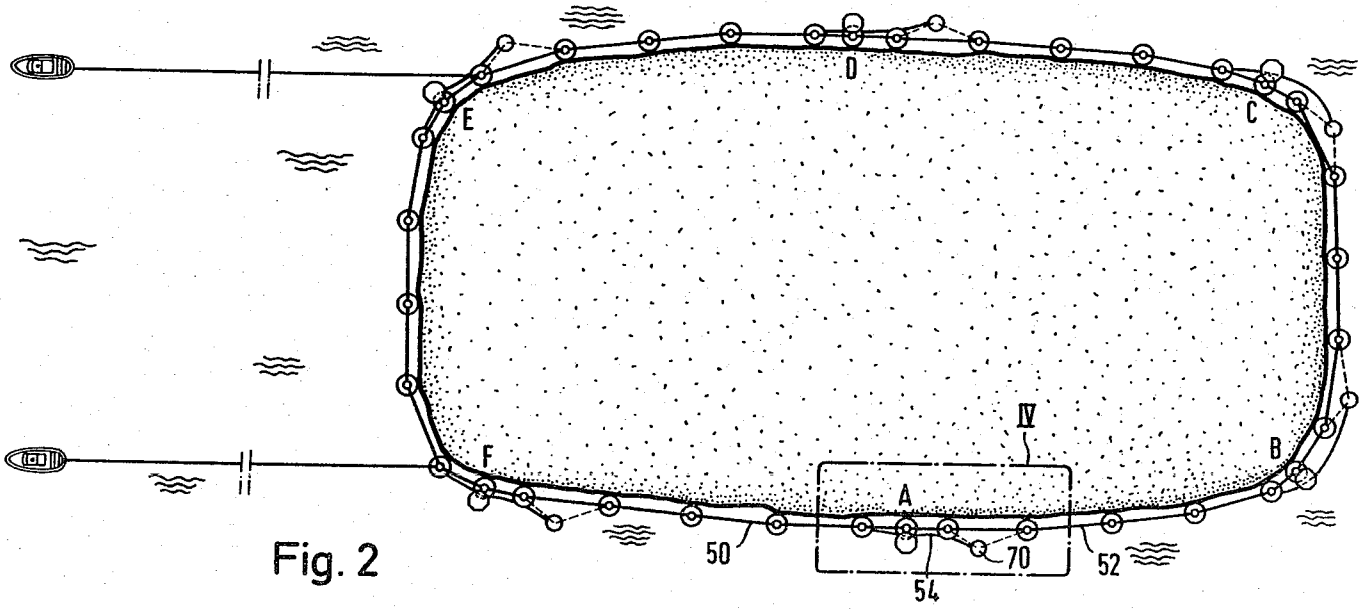
FIG. 2 is a plan view corresponding to FIG. 1.

Referring to FIGS. 1 and 2 it can be seen that the iceberg (10) is surrounded by its protective skirt which includes six winch posts designated A to F. The iceberg (10) is represented as being towed by two tugs (40 and 42) such that the posts E and F are towards the forward end of the iceberg (10) and the posts B and C are towards the stern.

Figure 3:
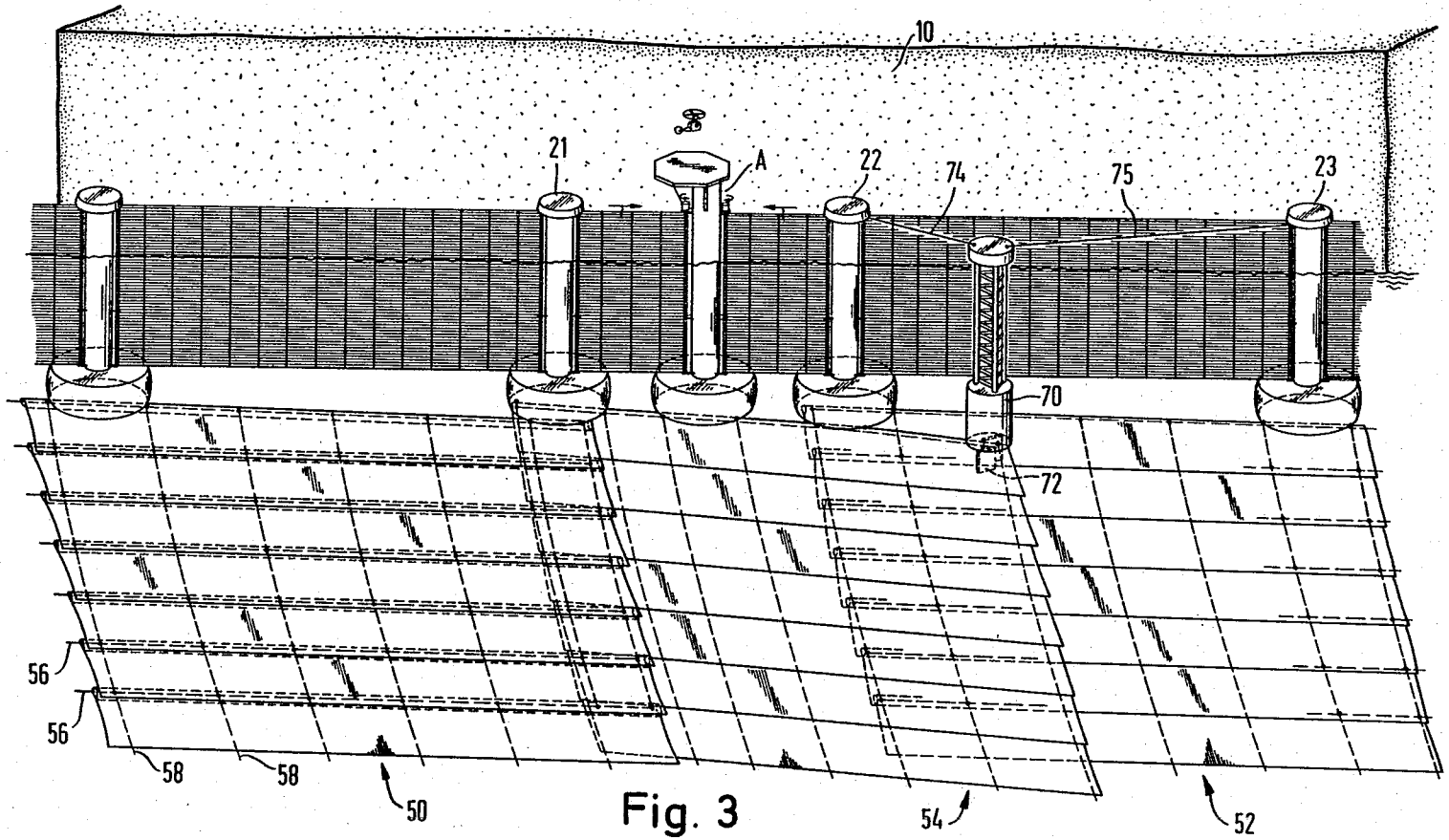
FIG. 3 is a side view, on a larger scale than FIG. 1, of a region indicated by an outline III in FIG. 1.

The lower protective portion of the skirt comprises six main spans (e.g. 50 or 52) suspended beneath each string of adjacent intermediate floating posts (i.e. a string that does not include a winch post), and six auxiliary spans (e.g. 54) bridging the gaps between adjacent main spans (e.g. 50 and 52). This can be seen more clearly in FIG. 3. The forward end of the auxiliary span (54) is supported by the same intermediate post (21) as supports the sternward end of the main span (50) forward of it. These spans overlap with the auxiliary span (54) on the iceberg side of the main span (50). In other words they overlap in the easier configuration for forward travel of the iceberg (10). The sternward end of the auxiliary span (54) is supported by an auxiliary float (70). This float (70) is disposed between the first and second intermediate posts (22, 23) supporting the forward end of the main span (52) which is immediately to the stern of the auxiliary span (54). Again there is an overlap in the easier configuration for forward travel, this time with the main span (52) is on the iceberg side of the auxiliary span (54). The float (70) is generally stable vertically inspite of wave action for the same reasons as the floating poles are stable vertically. Its principal buoyancy chamber is deep below the surface and the part which projects above the surface displaces relatively little water.

Each span of the lower portion of the skirt, whether a main span or an auxiliary span, has essentially the same construction. An array or grid of horizontal cables (e.g. 56) held substantially parallel by vertical cables (e.g. 57) is suspended beneath the intermediate posts (and an auxiliary float 70 in the case of an auxiliary span). Each horizontal cable supports the upper hem of a strip (60) of flexible material whose lower hem is weighted by another horizontal cable (not shown) which is otherwise not secured to the array. Each strip (60) is of sufficient width (say 20 meters or more) to overlap the strip immediately below it. This entire structure of overlapping strips (60) supported by an array of cables (56 and 58) is kept folded in the manner of a Venetian blind until the upper portion of the skirt is properly in place around the iceberg (10). Thereafter the lower portion is extended downwards also in the manner of a Venetian blind.

Figure 4:
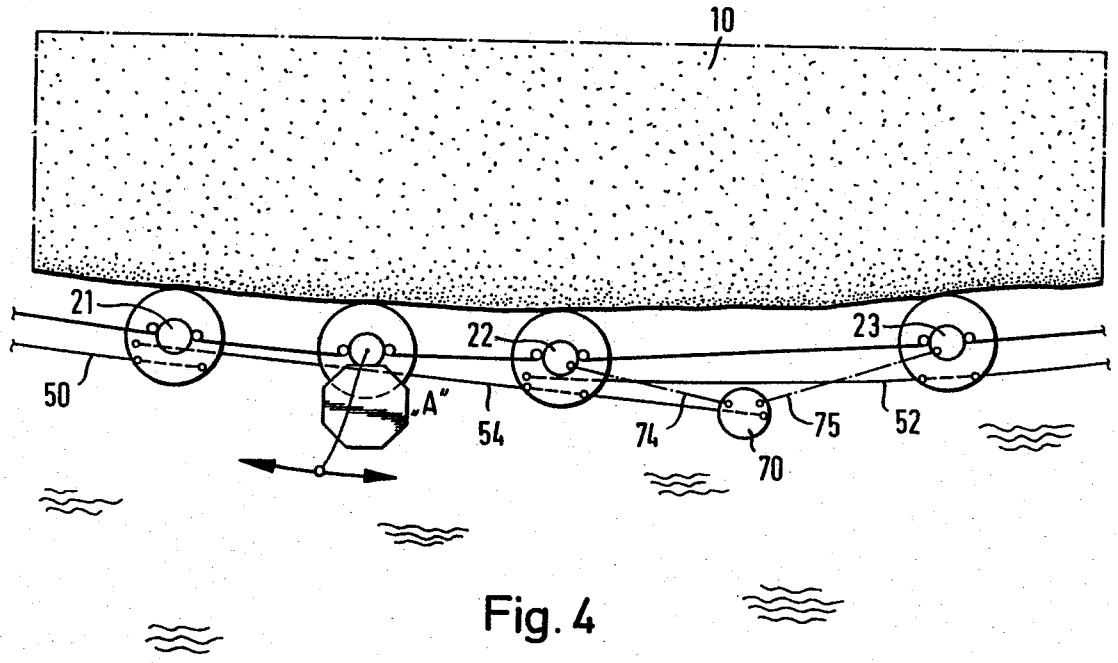
FIG. 4 is a plan view, on a larger scale than FIG. 2, of a region indicated by an outline IV in FIG. 2 and corresponding to the region III of FIG. 1.

The auxiliary float (70) has a fin (72) projecting beneath the float proper and angled so that movement of the iceberg through the water will tend to move the auxiliary float (70) outwardly away from the iceberg. The position of the auxiliary float (70) between the first two intermediate posts (22 and 23) of the main span (52) is adjusted by moorings (74, 75) which also serve to prevent the auxiliary float (70) from rotating so that its fin (72) no longer bites in the water. This disposition is best seen in the plan view of FIG. 4. The auxiliary span (54) has no connection with the winch post A under which it passes. This post is thus free to use its winches to draw in the panels (12) of the upper portion on either side thereof without interfering with the auxiliary span (54). The panels (12) are drawn-in by winching onto the furling drums (30), but any other form of panel-manipulating means that achieved the same ends would suffice. In particular the panels could be folded concerting fashion. After (or during) a drawing-in operation of the panels (12) of the upper portion, the only adjustment required to enable the lower portion to accomodate the shortening is to payout the forward mooring line (74) and draw in the sternward mooring line (75).

Although the skirt has been described as having a lower portion constituted by main spans and auxiliary spans separate therefrom, it would also be possible for the lower portion to be constituted by main spans only, with their sternward ends being diverted at intermediate posts such as (21) to a final support at an auxiliary float (70). The main drawback of such an arrangement is that the sternward ends of the span of the lower portion would need to be designated in advance of the skirt being deployed around the iceberg since the forward edge span has two sternward ends (at posts E and F) while the stern span has none (between posts B and C). With the present arrangement of auxiliary spans it is not too difficult with a stationary iceberg to deploy an auxiliary span in either direction depending on the actual circumstances.

Another feature which could be changed is that of freeing the winch posts from any lower portion supporting role. If a winch post is only capable of drawing in a panel on one and not on both sides thereof, then it could support a main span of the lower portion on its non-winch side and an auxiliary span too if its non-winch side is also its forward side. Such an arrangement does not make maximum use of the winch posts and is therefore not preferred.

NOMENCLATURE

A–F: particular winch posts
10: tabular iceberg
12: panels of protective skirt
14: surface of the sea
16: vertical tapes
18: horizontal straps
20: a winch post
21, 22, 23: intermediate posts
24: buoyancy chamber of floating post
26: pole of floating post
28: helicopter deck
30: furling drums
32: cap
34: pins
40, 42: tugs
50, 52: main spans of lower protective portion
54: auxiliary span of lower protective portion
56: horizontal cable
58: vertical cable
60: strip of flexible material
70: auxiliary float
72: fin
74, 75: moorings

I claim:

1. A protective skirt for a tabular iceberg, the skirt comprising:

a string of floating posts;

an upper protective portion in the form of panels suspended in a vertical plane between adjacent pairs of the floating posts;

a lower protective portion suspended below the floating posts; and at least one auxiliary float;

at least one of the floating posts including panel-manipulating means for drawing in at least one of the panels suspended therefrom, whereby the length of the string of floating posts may be shortened by shortening the length of at least one of the spans between floating posts;

the lower protective portion being attached to the floating posts in such a way that it is supported by the floating posts for each span of the string of floating posts that is not capable of being shortened by panel-manipulation means;

the lower protective portion including a vertically extending division associated with each floating post that includes panel-manipulating means, with one edge of the division being supported by one of the floating posts and the other edge of the division being supported by a corresponding auxiliary float, the length of the or each span of the lower protective portion having one end supported by the auxiliary float being such that the edges of the division overlap and the degree of overlap is adjustable by moving the position of the auxiliary float relative to the string of floating posts in order to accomodate shortenings of the length of the string of floats.

2. A protective skirt according to claim 1, wherein the lower protective portion includes two vertically extending divisions associated with each floating post that includes panel-manipulating means, thereby defining an auxiliary span of the lower protective portion, one end of the auxiliary span being suspended from a floating post with the ramainder of the lower protective portion overlapping it at the post, and the other end of the auxiliary span being supported by the auxiliary post.

3. A protective skirt according to claim 1 or 2, wherein the, or each floating post that includes panel-manipulating means, includes means for shortening two panels of the upper protective portion (one on either side of the post), and wherein the lower protective portion is not supported by the, or each floating post that includes panel-manipulating means.

4. A protective skirt according to claim 1 or 2, wherein the auxiliary float includes a fin to be acted upon by the flow of water past a tabular iceberg protected by the skirt, and further includes at least one mooring point for mooring to one of the floating posts of the string of posts, the relative disposition of the fin and the mooring point being such, that when in position around a tabular iceberg which is underway, the auxiliary float is urged away from the iceberg and is held against this urging by a mooring holding it to one of the floating posts.

* * * * *